United States Patent [19]

Siskin et al.

[11] Patent Number: 4,705,622

[45] Date of Patent: Nov. 10, 1987

[54] PROCESS FOR DEDUSTING SHALE-OIL

[75] Inventors: Michael Siskin, Livingston; Glen B. Brons, Phillipsburg, both of N.J.; Gary S. Green, Groton, Conn.

[73] Assignee: Exxon Research and Engineering Company, Florham Park, N.J.

[21] Appl. No.: 844,831

[22] Filed: Mar. 27, 1986

[51] Int. Cl.[4] ..... C10G 29/06; C10G 29/20; C10G 29/00; C10G 17/09

[52] U.S. Cl. ..... 208/289; 208/251 R; 208/290; 208/424

[58] Field of Search ..... 208/289, 290, 251 R, 208/424

[56] References Cited

U.S. PATENT DOCUMENTS

| | | | |
|---|---|---|---|
| 4,247,389 | 1/1981 | Johnson et al. | 208/251 R |
| 4,420,389 | 12/1983 | Beckworth et al. | 208/251 R |
| 4,424,118 | 1/1984 | Masogolites | 208/251 R |
| 4,490,238 | 12/1984 | Siskin | 208/403 |
| 4,491,513 | 1/1985 | Siskin et al. | 208/415 |
| 4,491,514 | 1/1985 | Siskin et al. | 208/435 |
| 4,518,484 | 5/1985 | Mann et al. | 208/251 R |
| 4,529,503 | 7/1985 | Kukes | 208/251 R |
| 4,544,477 | 10/1985 | Taylor | 208/424 |
| 4,551,237 | 11/1985 | Fenton | 208/251 R |
| 4,587,004 | 5/1986 | Siskin et al. | 208/435 |
| 4,587,005 | 5/1986 | Siskin et al. | 208/415 |

*Primary Examiner*—P. E. Konopka
*Attorney, Agent, or Firm*—Jay Simon

[57] ABSTRACT

Disclosed is a process for removing entrained mineral matter particles from shale-oil by contacting the shale-oil with an aqueous ammonium or phosphonium salt solution having a pH of about 0.5 to 8 and at a temperature from about 0° C. to 100° C.

12 Claims, No Drawings

PROCESS FOR DEDUSTING SHALE-OIL

FIELD OF THE INVENTION

The present invention relates to a process for the removal of entrained mineral matter particles from shale-oil by contacting the shale-oil with an aqueous ammonium or phosphonium salt solution, having a pH of about 0.5 to 8.

BACKGROUND OF THE INVENTION

Oil-shale, a sedimentary rock found in vast formations in several parts of the world, contains about 5 to 60 wt. % organic material. About 10% of this organic material is extractable with organic solvents and is called bitumen. The remainder of the organic material is insoluble in organic and inorganic solvents and is a cross-linked macromolecular material called kerogen. The remainder of the oil-shale is inorganic and is composed of various minerals including clays. Much work has recently been done to develop efficient methods for acquiring useful liquids and gases from oil-shale as replacements for petroleum products.

During conversion of oil-shale to liquid products, a significant amount of the mineral matter present in the oil-shale becomes entrained as fine particles in the resulting shale-oil. These fine mineral matter particles are usually present in an amount from about 2 to 30 wt. %, and are undesirable because they are not compatible with subsequent downstream processing. For example, in subsequent hydrotreating, these entrained fine particles have a tendency to poison the catalyst and to clog the reactor bed when present at levels greater than about 500 ppm.

Various techniques have been used in an attempt to lower the levels of these particles. Such techniques include electrostatic precipitation, ultra-filtration, and centrifugation. While these techniques have met with varying degrees of success, they all suffer from serious technical and/or economical disadvantages. For example, electrostatic precipitation requires numerous stages and is highly dependent on the age of the oil. That is, it will generally be effective for freshly produced oil, but not for oil more than as little as a few hours old. Ultrafiltration is very slow and requires constant cleaning and replacement of filters. Centrifugation, because of the large volume of oil, requires numerous vessels and constant maintenance because of mechanical problems.

Another method taught in the art for removing entrained mineral matter from hydrocarbon fuels is the method disclosed in German Pat. No. 722,406 to Pier et al in which a basic (pH>9) ammonium carbonate solution is used to remove mineral matter from an oil derived from brown coal at temperatures of 100°–400° C. Disadvantages associated with such a process include: (1) decomposition of the mineral matter at temperatures greater than 50° C. requires relatively high pressures; (2) undesirable emulsions form at a pH greater than about 9. Therefore, there is a need in the art for an economical process for removing fine mineral matter particles entrained in shale-oil without the disadvantages discussed above.

SUMMARY OF THE INVENTION

In accordance with the present invention, there is provided a process for removing entrained solids from shale-oil, which process comprises contacting the shale-oil with an effective amount of an aqueous ammonium or phosphonium salt solution, having a pH in the range of about 0.5 to 8, and at a temperature at which both the oil and the aqueous phase remain liquid.

In preferred embodiments of the present invention, the solution is an ammonium salt solution having a pH between about 5 and 7.

In other preferred embodiments of the present invention, the temperature is between about 30° C. and 100° C. and the mole ratio of ammonium salt to entrained solids is from about 1:1 to 1:10.

DETAILED DESCRIPTION OF THE INVENTION

The general composition and characteristics of oil-shale are well known (see "Kerogen" edited by B. Durand, Editors Technip, Paris 1980) and will therefore not be described in detail herein. Oil-shales containing at least about 5, preferably at least about 10, and more preferably at least about 20% by weight of organic material, based on the total weight of the oil-shale, are usually those which are commercially processed.

During processing, a significant amount of the mineral matter present in the oil-shale becomes entrained as fine particles suspended in the shale-oil. These fine particles will usually have an average particle size less than about 10$\mu$m . Particles larger than that will normally flocculate and, consequently, can easily be separated by conventional, physical separation techniques. The amount of fine particles usually entrained in shale-oil ranges from about 2 to about 30 wt. %, based on the total weight of the shale-oil plus entrained particles.

Oil-shales which are contemplated for commercial processing will contain at least about 7.5, preferably at least about 15, and more preferably between about 25 and 75 gallons of oil per ton of oil-shale, by Fischer Assay. Although the present invention can be practiced on any type of shale-oil, it is more advantageous to employ a shale-oil resulting from an oil-shale having a high carbonate and clay mineral matter content.

Ammonium and phosphonium salts suitable for use in the practice of the present invention are ammonium and phosphonium salts of organic and inorganic acids which provide an aqueous solution having a pH no greater than about 8. Preferred are the ammonium and phosphonium salts of strong mineral acids; more preferred are ammonium salts of strong acids. Non-limiting examples of such ammonium salts include ammonium acetate, ammonium chloride, ammonium nitrate, ammonium sulfate, and ammonium phosphates. Preferred are ammonium nitrate and ammonium sulfate; more preferred is ammonium sulfate.

An effective amount of salt solution is used in the practice of the present invention. The term "effective amount" when used with regard to the salt solution, means at least that amount which ensures that the mineral matter dissolves, or flocculates, from the shale-oil. It is to be understood that the actual amount needed for an effective amount will vary depending on the mineral matter to be removed. For example, if the mineral matter is clay, a salt solution at least slightly in excess of the cation exchange capacity of the clay should be used. Finally, if the mineral matter is quartz, then some ammonium ion will neutralize the negative charge on the surface of the crystallites and facilitate agglomeration and separation of the larger quartz particles.

Organic solvents can be used in the practice of the present invention to reduce the viscosity of the shale-oil. Organic solvents suitable for use herein are those which are immiscible with water. Non-limiting examples include toluene, heptane, BTX streams, cyclohexane, petroleum and coal-derived distillates, and boiling point fractions of shale-oil. By BTX streams, we mean streams comprised essentially of benzene, toluene, and xylenes. Preferred is a low to middle boiling point shale-oil fraction, especially one which is a product of the instant invention.

In the practice of the present invention, the ratio (by volume) of the organic phase to aqueous phase will depend on the desired viscosity at process temperatures. This ratio will usually range from about 0.4:1 to 2:1, preferably from about 0.4:1 to 1:1.

The temperatures at which the instant process is carried out is a temperature at which both the oil and the aqueous phase remain liquid. This temperature will generally be from about 0° C. to about 100° C., preferably about 60° C. to 100° C., when atmospheric pressure is employed. If higher pressures are employed, the temperature can be up to the temperature at which decomposition of any one or more of the ingredients of the system occurs. This upper temperature will usually not be higher than about 300° C. If ammonium and phosphonium salts are used which decompose at temperatures greater than about 50° C., then elevated pressures must be used to keep the components of the salts in solution.

In the practice of the present invention, the shale-oil is contacted with the aqueous ammonium or phosphonium solution for an effective amount of time, in an appropriate vessel, and at the aforementioned temperatures. The contacting can take place in one stage, or in two or more stages, as long as the pH of each stage is no greater than about 8. Of course, each stage must also be practiced within the temperature range previously mentioned herein. At pH's greater than about 8 emulsions are formed during the contacting which make subsequent separation of shale-oil product very difficult.

After a predetermined amount of entrained particles are removed from the shale-oil, a three phase system results. That is, there will be an upper organic (oil) phase, a middle aqueous phase, and a lower solids phase. The aqueous phase can, of course, be reconstituted with fresh ammonium or phosphonium salt, then recycled. The upper phase is comprised of the shale-oil, and solvent, if present, and contains a substantially reduced concentration of entrained mineral matter. The shale-oil may be separated from the solvent phase by conventional separation techniques.

If the instant invention is practiced in a single stage, then the pH of that stage should be between about 0.5 and 8. If two stages are used, then the first stage can be at a pH of about 5 to 8, or about 0.5 to 5, followed by a second stage which is at a pH in the range not chosen for the first stage. It is understood that any given stage may have more than one cycle.

The following examples serve to more fully describe the manner of practicing the above-described invention as well as to set forth the best modes contemplated for carrying out various aspects of the invention. It is to be understood that these examples in no way serve to limit the true scope of this invention, but rather, are presented for illustrative purposes.

EXAMPLES 1 (Comparative) and 2 and 3

Three samples, each weighing about 12 g, of Colorado shale-oil, containing 5.2 wt. % entrained mineral matter, also referred to herein as fines, were each introduced into separate reaction flasks. Two of the flasks contained 100 ml of a 2M ammonium sulfate solution, and the other flask contained 100 ml of distilled water. Toluene (10 ml) was used to wash the samples into the flasks. The reaction mixtures of Comparative Example 1 and Example 3 were stirred under nitrogen for 30 minutes at a temperature of 67° C., and Example 2 was stirred under nitrogen for 15 minutes, also at 67° C. Examples 2 and 3, which contained the ammonium sulfate solution, produced a three-layer system, that is, an organic layer, an aqueous layer, and a layer of solids on the bottom of the flasks. The aqueous layer was observed to be yellow in color and contained solids which were dark gray in color. Example 1, which did not contain the ammonium sulfate, was observed to have a colorless aqueous layer without a solids precipitate.

The reaction mixtures were transferred to separatory funnels while still hot. The aqueous layers were separated, filtered, and the remaining solids were dried at room temperature (22° C.) under nitrogen. The toluene layer was washed with water to remove residual ammonium sulfate.

The original sample, product oils, and solids were analyzed by thermogravimetric analysis (TGA). The results are summarized in Tables I and II below. The data of these tables show that reaction with aqueous ammonium sulfate at 67° C., for 30 minutes, at atmospheric pressure, removes 93% of the fines in the oil (5.2 wt. % down to 0.36 wt. %). A second 30 minute treatment resulted in additional removal of fines, yielding a cumulative removal of 98% of the original fines.

TABLE I

| | | | | OIL | | |
|---|---|---|---|---|---|---|
| FEED | REAGENT | t (MIN.) | T (°C.) | ASH (Wt. %) | CARBON RESIDUE (Wt. %) | ASH REMOVED (Wt. %) |
| PSU OIL[a] | — | — | — | 5.1 | 1.7 | (5.3)[b] |
| PSU OIL | $H_2O$ | 30 | 67 | | NO REACTION | |
| PSU OIL | $(NH_4)_2SO_4$ | 15 | 67 | 1.0 | 1.5 | 80 |
| PSU OIL | $(NH_4)_2SO_4$ | 30 | 67 | 0.36 | 2.0 | 93 |
| ASH OIL (0.36%) | $(NH_4)_2SO_4$ | 30 | 67 | 0.11 | 0.8 | 98 |

[a]PSU 9209-YP(3) insulated whole oil, Colorado feed oil-shale, steam retorted at 900° F., integrated.

[b]Raw oil solids filtered and toluene washed.

TABLE II

DEDUSTING OF COLORADO SHALE OIL USING AQUEOUS AMMONIUM SULFATE

| FEED | REAGENT | t (MIN.) | T (°C.) | PRECIPITATED SOLIDS[a] ASH (Wt. %) | CARBON RESIDUE (Wt. %) | VOLATILE ORGANICS (Wt. %) | TOTALS VOLATILES[b] / ASH |
|---|---|---|---|---|---|---|---|
| PSU OIL [a] | — | — | — | 78.7 | <3.0 | 25.5 | 0.32 |
| PSU OIL | $H_2O$ | 30 | 67 | | | NONE | |
| PSU OIL | $(NH_4)_2SO_4$ | 15 | 67 | 83.0 | 2.6 | 14.4 | 0.20 |
| PSU OIL | $(NH_4)_2SO_4$ | 30 | 67 | 84.1 | 2.0 | 13.9 | 0.19 |
| 0.36%/ASH OIL | $(NH_4)_2SO_4$ | 30 | 67 | | | TRACES | |

[a]TGA data is on filtered solids in the raw oil case and on dedusted oil solids precipitated into the aqueous layer in the other cases.
[b]Volatiles include organics plus carbon dioxide.

EXAMPLES 4–6

Each of three 10 g samples of Colorado shale-oil, containing 5.2 wt. % fines, were mixed with 5 ml of xylenes, and 100 ml of 2M ammonium sulfate and stirred for 30 minutes in reaction flasks. The sample of Example 4 was stirred at a temperature of 65° C., Example 5 at 85° C., and Example 6 at 94° C. Each experiment resulted in a three-phase system, that is, an organic layer, an aqueous layer, and solids. The aqueous layer of each was observed to be yellow in color with a dark gray solids residue. This evidences that a reaction had taken place, for each experiment, resulting in the removal of fines from the shale-oil. The products were analyzed as in the above examples and the results are shown in Table III below.

TABLE III

| Example | 4 | 5 | 6 |
|---|---|---|---|
| Temperature (°C.) | 65 | 85 | 94 |
| % Fines Removed | 50.8 | 63.5 | 84.6 |

The above data illustrates that elevated temperatures improve the removal of fines from shale-oil with a maximum removal of 84.6 wt. % at 94° C., for a single stage process.

EXAMPLES 7 AND 8

Each of two 10 g samples of Colorado shale-oil containing 5.2 wt. % fines, were stirred for 30 minutes at 85° C. with 100 ml of 2M ammonium sulfate solution. To the sample of Example 8, 50 vol. % (5 ml) of xylenes was added. After analysis, it was shown that Example 7 resulted in removal of 63.4% fines removal, and Example 8, with the xylene co-solvent, resulted in removal of only 55.4% removal of fines. These examples illustrate that a co-solvent, such as xylenes, is not required for the practice of the present invention when the present invention is practiced at elevated temperatures, such as at a temperature of about 85° C., and above.

EXAMPLES 9 AND 10

Two 10 g samples of Colorado shale-oil were heated at 94° C. for 30 minutes in reaction flasks. The sample of Example 10 was introduced into the reaction flask and diluted with 50 vol. % xylenes (5 ml) to which 50 ml of an aqueous ammonium sulfate solution was added which contained 1 equivalent of ammonium sulfate based on the assumption that the fines in the oil are calcium carbonate. The sample of Example 10 was also diluted with 50 vol. % xylenes and 50 ml of a 2M aqueous ammonium sulfate solution, which is of course excess of 1 equivalent.

After analyzing the treated shale-oil, it was found that 48.1% of the fines was removed when treated with the 1 equivalent solution of ammonium sulfate, versus 84.6% removal of fines when treated with the 2M ammonium sulfate solution.

This example shows that increased amounts of entrained mineral matter can be removed as the concentration of ammonium sulfate solution is increased.

EXAMPLE 11

The treated shale-oil of Example 9 above was subjected to two more 30 minute treatments. After the first retreatment, it was found that a total of 80.8% of the fines was removed, and after the second retreatment, it was found that more than a total of 99% of the fines was removed from the original shale-oil. This example demonstrates the benefit of using more than one cycle in a single stage.

EXAMPLES 12 and 13

To each of two 10 g samples of Colorado shale-oil, there was added 50 ml of an aqueous solution containing 1 equivalent of ammonium sulfate, based on the assumption that all of the fines of the shale-oil are calcium carbonate. One sample was heated at 94° C. for 30 minutes and the other at that same temperature for 60 minutes. It was found that the 30 minute treatment removed 50.7% of the fines, and the 60 minute treatment removed 60.9% of the fines. The treated shale-oil from the 30 minute treatment was given a second treatment, identical to the first, for another 30 minutes. It was found that after this second treatment, a total of 75% of the fines had been removed from the starting shale-oil.

These examples illustrate that two 30 minute cycles are more effective than one 60 minute treatment for the removal of fines from shale-oil.

EXAMPLES 14–16

Three 10 g samples of Colorado shale-oil were prepared. Each contained 50 ml water. The sample of Example 14 contained no ammonium sulfate, the sample of Example 15 contained a $\frac{1}{3}$ equivalent of ammonium sulfate, and the sample of Example 16 contained 1 equivalent of ammonium sulfate, which equivalents were based on the assumption that the entrained fines are calcium carbonate. The samples of Examples 15 and 16 were further divided into two equal portions each. One portion was treated at a pH of about 6–7 and the other at a pH of 2 by the addition of dilute sulfuric acid. The sample of Example 14 was also at a pH of 2. The amount of fines removed for each example is set forth in Table IV below.

TABLE IV

| Example | 14 | 15 | | 16 | |
|---|---|---|---|---|---|
| Equivalent | 0 | ⅓ | | 1 | |
| pH | 2 | 6–7 | 2 | 6–7 | 2 |
| % Fines Removed | 55.9 | 35.6 | 66.6 | 50.7 | 78.6 |

The above table illustrates that more fines are removed from the shale-oil when increased concentrations of ammonium sulfate are used. Also, a lower pH results in a more efficient removal of fines.

EXAMPLES 17–20

Four samples of 10 g of the Colorado shale-oil as used in the previous examples was prepared with each containing 1 equivalent of ammonium sulfate in an aqueous solution, wherein the equivalent is based on the assumption that all of the fines of the shale-oil the assumption that all of the fines of the shale-oil are calcium carbonate. The samples differed only with respect to the molarity of the ammonium sulfate solution. Each sample was heated for 30 minutes at a temperature of 94° C. The molarity of each sample and the percent of fines removal from the shale-oil is set forth in Table V below.

TABLE V

| Example | Molarity | % of Fines Removed |
|---|---|---|
| 17 | 0.545 | 91.9 |
| 18 | 0.363 | 64.8 |
| 19 | 0.215 | 62.5 |
| 20 | 0.109 | 50.7 |

The above data illustrates the effect of concentration of ammonium sulfate solution on the removal of fines from the shale-oil. That is, the more concentrated solutions removed a higher level of fines than the less concentrated solutions. These examples also illustrate the importance of maintaining a higher density difference between the aqueous and oil phases in the practice of the present invention.

What is claimed is:

1. A process for removing entrained mineral matter particles from shale-oil, which process comprises contacting the shale-oil with an effective amount of an aqueous solution of an ammonium salt of a strong acid, having a pH in the range of about 0.5 to 8, at a temperature at which both the oil and aqueous phases remain liquid.

2. The process of claim 1 wherein the pH of the aqueous salt solution is between about 5 and 7.

3. The process of claim 2 wherein the temperature of contacting is between about 0° C. and 100° C.

4. The process of claim 3 wherein the mole ratio of ammonium salt to entrained solids is from about 1:1 to about 1:10.

5. The process of claim 1 which is conducted in two or more stages wherein one stage is at a pH of about 5 to 8 and the other is at a pH of about 0.5 to 5.

6. The process of claim 1 wherein the salt is selected from ammonium chloride, ammonium nitrate, ammonium sulfate, and ammonium phosphate.

7. The process of claim 4 wherein the salt is selected from ammonium chloride, ammonium nitrate, ammonium sulfate, and ammonium phosphate.

8. The process of claim 1 wherein the shale oil contains an added organic solvent selected from toluene, heptane, BTX streams, cyclohexane, petroleum and coal-derived distillates, and boiling point fractions of shale-oil.

9. The process of claim 7 wherein the shale oil contains an added organic solvent selected from toluene, heptane, BTX streams, cyclohexane, petroleum and coal-derived distillates, and a low to middle boiling point fraction of shale-oil.

10. The process of claim 9 wherein the organic solvent is a low to middle boiling point fraction of shale-oil.

11. The process of claim 10 which is conducted at a temperature from about 60° C. to about 100° C.

12. The process of claim 9 which is conducted in two or more stages wherein one stage is at a pH of about 5 to 8 and the other is at a pH of about 0.5 to 5.

* * * * *